US012007152B2

(12) United States Patent
Oyama

(10) Patent No.: US 12,007,152 B2
(45) Date of Patent: Jun. 11, 2024

(54) STARTING METHOD FOR CRYOCOOLER AND CRYOCOOLER

(71) Applicant: SUMITOMO HEAVY INDUSTRIES, LTD., Tokyo (JP)

(72) Inventor: Shuji Oyama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 277 days.

(21) Appl. No.: 17/371,137

(22) Filed: Jul. 9, 2021

(65) Prior Publication Data

US 2021/0341199 A1 Nov. 4, 2021

Related U.S. Application Data

(63) Continuation of application No. PCT/JP2020/000516, filed on Jan. 9, 2020.

(30) Foreign Application Priority Data

Jan. 15, 2019 (JP) ..... 2019-004076

(51) Int. Cl.
*F25B 49/02* (2006.01)

(52) U.S. Cl.
CPC ..... *F25B 49/022* (2013.01); *F25B 2500/26* (2013.01); *F25B 2600/024* (2013.01); *F25B 2700/193* (2013.01); *F25B 2700/2104* (2013.01)

(58) Field of Classification Search
CPC ..... F25B 49/022; F25B 2500/024; F25B 2600/024; F25B 2700/193; F25B 2700/2104
See application file for complete search history.

(56) References Cited

U.S. PATENT DOCUMENTS

| | | | | |
|---|---|---|---|---|
| 6,655,154 | B2 | 12/2003 | Funayama et al. | |
| 10,280,913 | B2 | 5/2019 | Matsui | |
| 2013/0232999 | A1* | 9/2013 | Matsui | F25B 45/00 62/55.5 |

FOREIGN PATENT DOCUMENTS

| | | | |
|---|---|---|---|
| JP | H04236069 | A | 8/1992 |
| JP | H08313086 | A | 11/1996 |
| JP | H11281182 | A | 10/1999 |
| JP | 3439651 | B2 | 8/2003 |
| JP | 3754992 | B2 | 3/2006 |
| JP | 2014173819 | A | 9/2014 |

* cited by examiner

*Primary Examiner* — Nael N Babaa
(74) *Attorney, Agent, or Firm* — HEA LAW PLLC

(57) ABSTRACT

There is provided a starting method for a cryocooler, the cryocooler including a compressor, a cold head, a high pressure line, and a low pressure line, the method including increasing a volume of the high pressure line when the cold head is at a room temperature, cooling the cold head from the room temperature to a cryogenic temperature while controlling an operation frequency of the compressor based on a pressure of the high pressure line or a differential pressure between the high pressure line and the low pressure line, after the volume of the high pressure line has been increased, decreasing the volume of the high pressure line after the cold head has been cooled to the cryogenic temperature, and maintaining the cold head at the cryogenic temperature after the volume of the high pressure line has been decreased.

12 Claims, 8 Drawing Sheets

STARTING METHOD FOR CRYOCOOLER AND CRYOCOOLER

RELATED APPLICATIONS

The contents of Japanese Patent Application No. 2019-004076, and of International Patent Application No. PCT/JP2020/000516, on the basis of each of which priority benefits are claimed in an accompanying application data sheet, are in their entirety incorporated herein by reference.

BACKGROUND

Technical Field

Certain embodiments of the present invention relate to a starting method for a cryocooler and a cryocooler.

Description of Related Art

A cryocooler is used in order to cool various target objects such as a superconducting device used in a cryogenic temperature environment, a measuring device, and a sample.

SUMMARY

According to one aspect of the present invention, there is provided a starting method for a cryocooler. The cryocooler includes a compressor, a cold head, a high pressure line through which a refrigerant gas is supplied from the compressor to the cold head, and a low pressure line through which the refrigerant gas is collected from the cold head to the compressor. The method includes increasing a volume of the high pressure line when the cold head is at a room temperature, cooling the cold head from the room temperature to a cryogenic temperature while controlling an operation frequency of the compressor based on a pressure of the high pressure line or a differential pressure between the high pressure line and the low pressure line, after the volume of the high pressure line has been increased, decreasing the volume of the high pressure line after the cold head has been cooled to the cryogenic temperature, and maintaining the cold head at the cryogenic temperature after the volume of the high pressure line has been decreased.

According to another aspect of the present invention, there is provided a cryocooler including a compressor, a cold head, a high pressure line through which a refrigerant gas is supplied from the compressor to the cold head, a low pressure line through which the refrigerant gas is collected from the cold head to the compressor, a pressure sensor that measures a pressure of the high pressure line or a differential pressure between the high pressure line and the low pressure line, a compressor controller that controls an operation frequency of the compressor based on the pressure measured by the pressure sensor, and a buffer volume configured to be connected to the high pressure line when the cold head is cooled from a room temperature to a cryogenic temperature, and the buffer volume is configured to be disconnected from the high pressure line when the cold head is maintained at the cryogenic temperature.

According to still another aspect of the present invention, there is provided a cryocooler including a compressor, a cold head, a high pressure line through which a refrigerant gas is supplied from the compressor to the cold head, a low pressure line through which the refrigerant gas is collected from the cold head to the compressor, a pressure sensor that measures a pressure of the high pressure line or a differential pressure between the high pressure line and the low pressure line, and a compressor controller that controls an operation frequency of the compressor based on the pressure measured by the pressure sensor. A volume of the high pressure line is larger than a volume of the low pressure line.

Any combination of the components described above and a combination obtained by switching the components and expressions of the present invention between methods, devices, and systems are also effective as an embodiment of the present invention.

DETAILED DESCRIPTION

To cool a target object with a cryocooler, first, it is necessary to start the cryocooler and to cool the cryocooler from an initial temperature, such as the room temperature (for example, a temperature in the range of approximately 280 K to approximately 300 K), to a target cryogenic temperature (for example, a temperature in the range of approximately 4 K to approximately 50 K). This is also called cooldown of the cryocooler. Since the cooldown is merely preparation for beginning the cooling of the target object, it is desirable that time taken for the cooldown is as short as possible.

It is desirable to shorten the cooldown time of the cryocooler.

Hereinafter, embodiments for carrying out the present invention will be described in detail with reference to the drawings. In the description and drawings, the same or equivalent components, members, and processing will be assigned with the same reference symbols, and redundant description thereof will be omitted as appropriate. The scales and shapes of illustrated parts are set for convenience in order to make the description easy to understand, and are not to be understood as limiting unless stated otherwise. The embodiments are merely examples and do not limit the scope of the present invention. All characteristics and combinations to be described in the embodiments are not necessarily essential to the invention.

Figure 1:
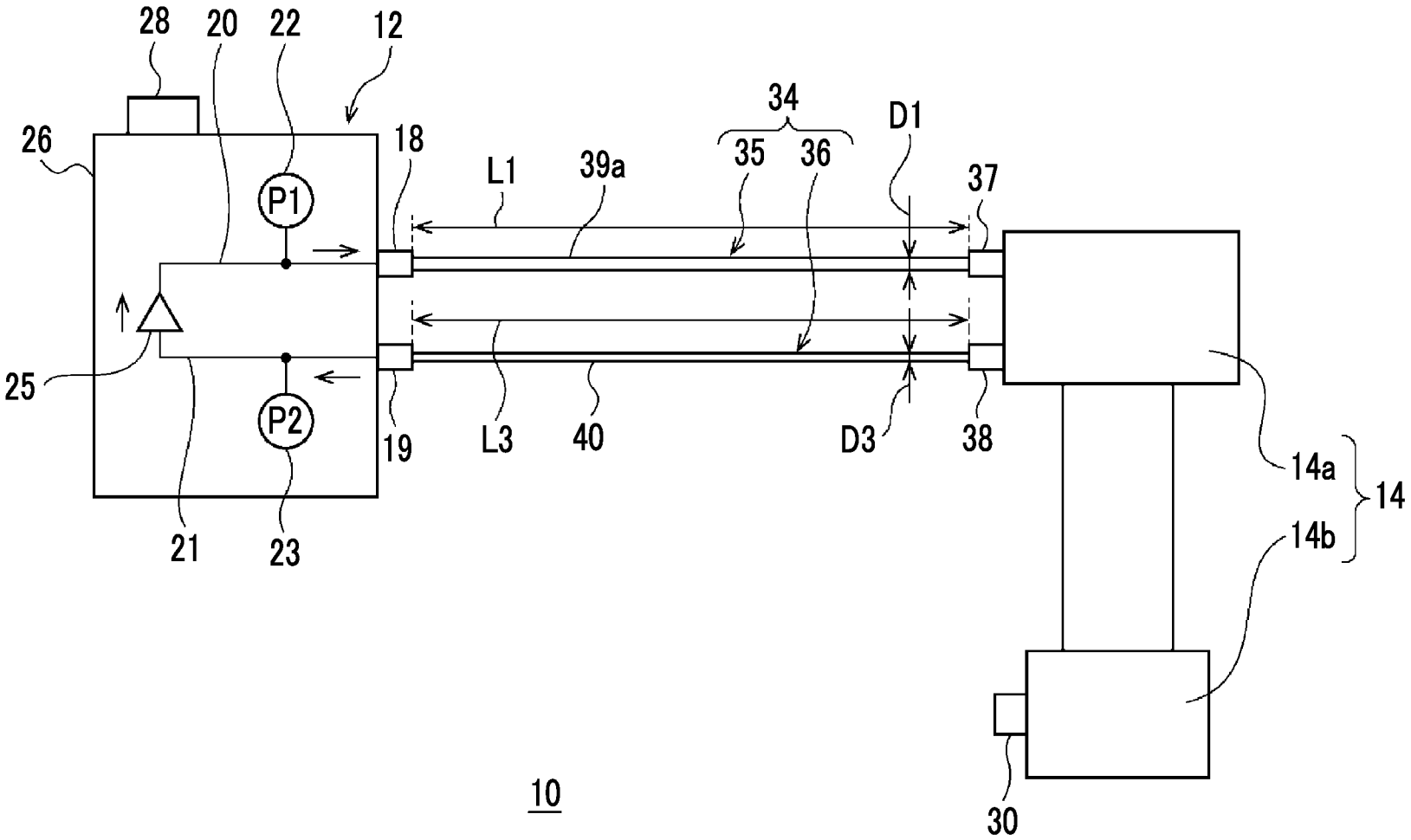
FIG. 1 is a view schematically illustrating a cryocooler according to one embodiment.
Figure 2:
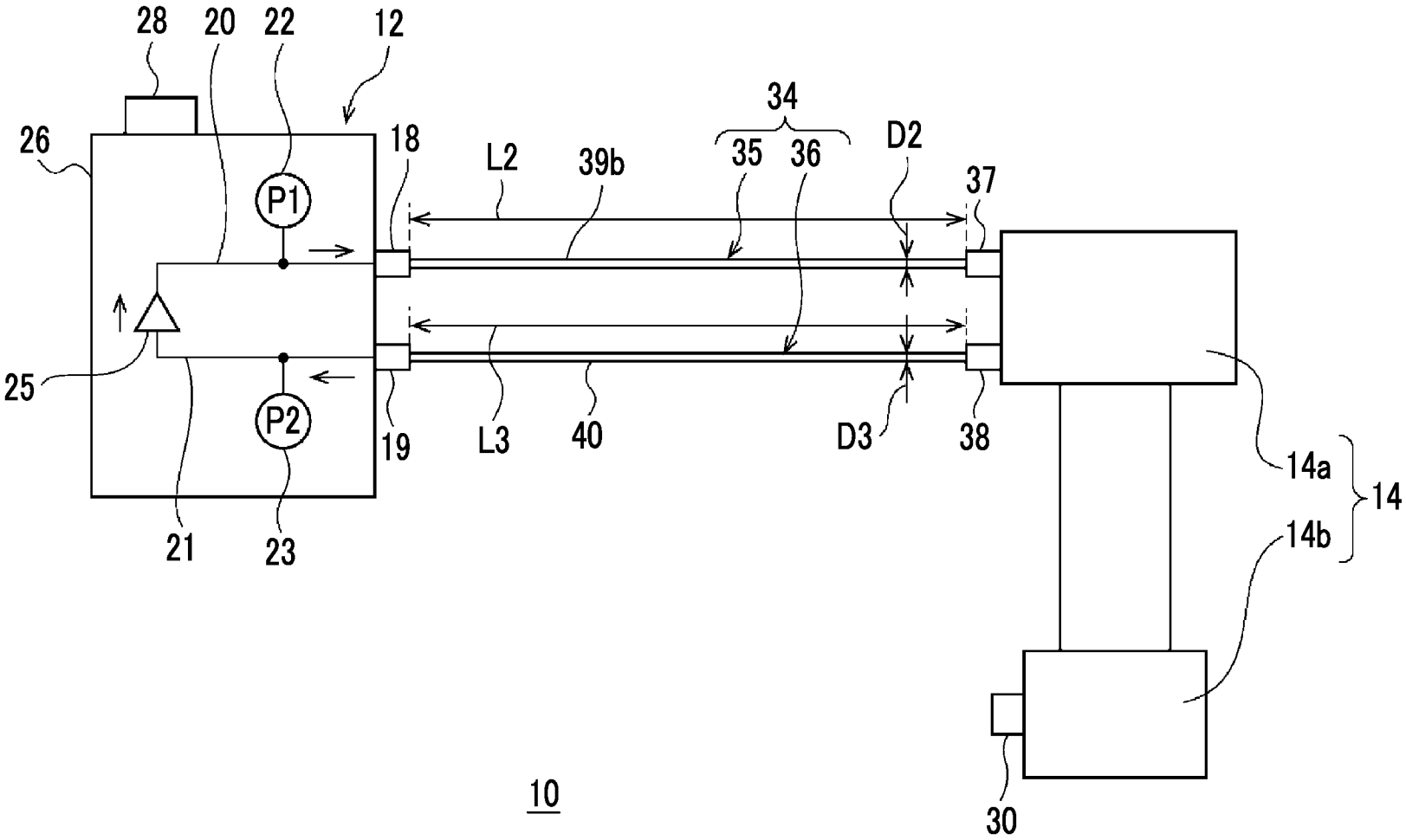
FIG. 2 is a view schematically illustrating the cryocooler according to the one embodiment.

FIGS. 1 and 2 are views schematically illustrating a cryocooler 10 according to one embodiment. FIG. 1 illustrates cooldown operation of the cryocooler 10, and FIG. 2 illustrates normal cooling operation of the cryocooler 10. The cryocoolers 10 illustrated in FIGS. 1 and 2 are the same except that a high pressure side pipe of the cryocooler 10 is replaced and a refrigerant gas volume on a high pressure side is different.

During cooldown operation, the cryocooler 10 is quickly cooled from a room temperature or an initial temperature near the room temperature to a target cooling temperature. The target cooling temperature is selected from desired cryogenic temperatures for cooling a superconducting device such as a superconducting magnet or other objects to be cooled. Normal cooling operation is performed subsequent to the cooldown operation so that the cryocooler 10 is maintained at the target cooling temperature. When the normal cooling operation begins, an object to be cooled can be operated. As a preparatory stage, the cooldown operation is performed.

Although details will be described later, a refrigerant gas volume on the high pressure side during cooldown operation is increased compared to normal cooling operation. It can be said that the refrigerant gas volume on the high pressure side is increased during the cooldown operation compared to a low pressure side.

The cryocooler 10 includes a compressor 12 and a cold head 14. The compressor 12 is configured to collect a working gas of the cryocooler 10 from the cold head 14, to pressurize the collected working gas, and to supply the working gas to the cold head 14 again. The cold head 14 is also called an expander and has a room temperature section 14*a* and a low-temperature section 14*b* which is also called a cooling stage. The compressor 12 and the cold head 14 configure a refrigeration cycle of the cryocooler 10, and thereby the low-temperature section 14*b* is cooled to a desired cryogenic temperature. The working gas is also called a refrigerant gas, and other suitable gases may be used although a helium gas is typically used. To facilitate understanding, a direction in which the working gas flows is shown with an arrow in FIG. 1.

Although the cryocooler 10 is, for example, a single-stage or two-stage Gifford-McMahon (GM) cryocooler, the cryocooler may be a pulse tube cryocooler, a Stirling cryocooler, or other types of cryocoolers. Although the cold head 14 has a different configuration according to the type of the cryocooler 10, the compressor 12 can use the configuration described below regardless of the type of the cryocooler 10.

In general, both of a pressure of the working gas supplied from the compressor 12 to the cold head 14 and a pressure of the working gas collected from the cold head 14 to the compressor 12 are considerably higher than the atmospheric pressure, and can be called a first high pressure and a second high pressure, respectively. For convenience of description, the first high pressure and the second high pressure are also simply called a high pressure and a low pressure, respectively. Typically, the high pressure is, for example, 2 to 3 MPa. The low pressure is, for example, 0.5 to 1.5 MPa, and is, for example, approximately 0.8 MPa.

The compressor 12 includes a discharge port 18, a suction port 19, a high pressure flow path 20, a low pressure flow path 21, a first pressure sensor 22, a second pressure sensor 23, a compressor main body 25, and a compressor casing 26. The discharge port 18 is provided in the compressor casing 26 as a working gas discharge port of the compressor 12, and the suction port 19 is provided in the compressor casing 26 as a working gas suction port of the compressor 12. The high pressure flow path 20 connects a discharge port of the compressor main body 25 to the discharge port 18, and the low pressure flow path 21 connects the suction port 19 to a suction port of the compressor main body 25. The compressor casing 26 accommodates the high pressure flow path 20, the low pressure flow path 21, the first pressure sensor 22, the second pressure sensor 23, and the compressor main body 25. The compressor 12 is also called a compressor unit.

The compressor main body 25 is configured to internally compress a working gas sucked from the suction port and to discharge the working gas from the discharge port. The compressor main body 25 may be, for example, a scroll type pump, a rotary type pump, or other pumps that pressurize the working gas. The compressor main body 25 may be configured to discharge the working gas at a fixed and constant flow rate. Alternatively, the compressor main body 25 may be configured to change the flow rate of the working gas to be discharged. The compressor main body 25 is called a compression capsule in some cases.

The first pressure sensor 22 is disposed in the high pressure flow path 20 to measure the pressure of a working gas flowing in the high pressure flow path 20. The first pressure sensor 22 is configured to output a first measured pressure signal P1 indicating the measured pressure. The second pressure sensor 23 is disposed in the low pressure flow path 21 to measure the pressure of the working gas flowing in the low pressure flow path 21. The second pressure sensor 23 is configured to output a second measured pressure signal P2 indicating the measured pressure. Accordingly, the first pressure sensor 22 and the second pressure sensor 23 can also be called a high pressure sensor and a low pressure sensor, respectively. In addition, in the specification, any one of the first pressure sensor 22 and the second pressure sensor 23 or both of the first pressure sensor and the second pressure sensor will be collectively and simply referred to as a "pressure sensor" in some cases.

The pressure sensor may include a differential pressure sensor. The differential pressure sensor may be provided, for example, in a bypass line that connects the high pressure flow path 20 and the low pressure flow path 21 to each other to bypass the compressor main body 25. The differential pressure sensor is configured to measure a differential pressure between the high pressure and the low pressure of a working gas in the cryocooler 10 and to output a measured differential pressure signal indicating the measured differential pressure. The differential pressure sensor may be provided instead of or in addition to the high pressure sensor and the low pressure sensor.

The compressor 12 can have other various components. For example, an oil separator or an adsorber may be provided in the high pressure flow path 20. A storage tank and other components may be provided in the low pressure flow path 21. In addition, an oil circulation system that cools the compressor main body 25 with an oil and a cooling system that cools the oil may be provided in the compressor 12.

The cryocooler 10 includes a main switch 28. The main switch 28 includes an operation tool that can be manually operated, such as an operation button and a switch. When operated, the cryocooler 10 is started and operation thereof begins. The main switch 28 may function not only as a start switch of the cryocooler 10 and but also serve as a stop switch of the cryocooler 10. The main switch 28 is provided on, for example, the compressor casing 26.

The cold head 14 includes a cold head temperature sensor 30 attached to the low-temperature section 14*b*. The cold head temperature sensor 30 is configured to output a measured temperature signal T1 indicating the measured temperature of the low-temperature section 14*b*.

In addition, the cryocooler 10 includes a pipe system 34 that allows a working gas to circulate between the compressor 12 and the cold head 14. The pipe system 34 includes a high pressure line 35 through which the working gas is supplied from the compressor 12 to the cold head 14 and a low pressure line 36 through which the working gas is collected from the cold head 14 to the compressor 12. The room temperature section 14*a* of the cold head 14 includes a high pressure port 37 and a low pressure port 38.

The high pressure port 37 is connected to the discharge port 18 by a first high-pressure pipe 39*a* or a second high-pressure pipe 39*b*. As illustrated in FIG. 1, the first high-pressure pipe 39*a* is used during cooldown operation. As illustrated in FIG. 2, the second high-pressure pipe 39*b* is used during normal cooling operation. Hereinafter, the first high-pressure pipe 39*a* and the second high-pressure pipe 39*b* will be collectively called a high-pressure pipe 39 in some cases. The low pressure port 38 is connected to the suction port 19 by a low-pressure pipe 40.

A working gas to be collected from the cold head 14 to the compressor 12 passes through the low-pressure pipe 40 from the low pressure port 38 of the cold head 14 to enter the suction port 19 of the compressor 12, and further returns to the compressor main body 25 via the low pressure flow path 21 so as to be compressed and pressurized by the compressor main body 25. The working gas to be supplied from the compressor 12 to the cold head 14 passes through the high pressure flow path 20 from the compressor main body 25 to exit from the discharge port 18 of the compressor 12, and is further supplied to the cold head 14 via the high-pressure pipe 39 and the high pressure port 37 of the cold head 14.

For example, the high-pressure pipe 39 and the low-pressure pipe 40 are configured by flexible pipes, but may be configured by rigid pipes. Detachable couplings are provided at both ends of the high-pressure pipe 39 and the low-pressure pipe 40. Couplings that are detachable from the couplings at both ends of the high-pressure pipe 39 are provided at the discharge port 18 and the high pressure port 37, and couplings that are detachable from the couplings at both ends of the low-pressure pipe 40 are provided at the suction port 19 and the low pressure port 38. The detachable couplings are, for example, self-sealing couplings. Accordingly, the high-pressure pipe 39 and the low-pressure pipe 40 are removably attached to the compressor 12 and the cold head 14.

As can be understood from comparison between FIGS. 1 and 2, the volume of the high pressure line 35 during cooldown operation is larger than the volume of the high pressure line 35 during normal cooling operation. As an exemplary configuration, the volume of the first high-pressure pipe 39*a* is larger than the volume of the second high-pressure pipe 39*b*. The first high-pressure pipe 39*a* is thicker than the second high-pressure pipe 39*b*. A nominal diameter D1 of the first high-pressure pipe 39*a* is larger than a nominal diameter D2 of the second high-pressure pipe 39*b*. For example, the first high-pressure pipe 39*a* may be a pipe having a nominal diameter one or two larger than that of the second high-pressure pipe 39*b*. Instead of or in addition to the first high-pressure pipe 39*a* being thicker, the first high-pressure pipe 39*a* may be longer than the second high-pressure pipe 39*b*. Although a length L1 of the first high-pressure pipe 39*a* is equal to a length L2 of the second high-pressure pipe 39*b* in FIGS. 1 and 2, for example, the length L1 of the first high-pressure pipe 39*a* may be within a range one to two times the length L2 of the second high-pressure pipe 39*b*.

In addition, as illustrated in FIG. 1, during cooldown operation, the volume of the high pressure line 35 is larger than the volume of the low pressure line 36. As an exemplary configuration, the volume of the first high-pressure pipe 39*a* is larger than the volume of the low-pressure pipe 40. The first high-pressure pipe 39*a* is thicker than the low-pressure pipe 40. The nominal diameter D1 of the first high-pressure pipe 39*a* is larger than a nominal diameter D3 of the low-pressure pipe 40. For example, the first high-pressure pipe 39*a* may be a pipe having a nominal diameter one or two larger than that of the low-pressure pipe 40. Instead of or in addition to the first high-pressure pipe 39*a* being thicker, the first high-pressure pipe 39*a* may be longer than the low-pressure pipe 40. Although the first high-pressure pipe 39*a* and the low-pressure pipe 40 have lengths equal to each other in FIG. 1, for example, the length L1 of the first high-pressure pipe 39*a* may be within a range one to two times a length L3 of the low-pressure pipe 40.

As illustrated in FIG. 2, the volumes of the high pressure line 35 and the low pressure line 36 are equal to each other during normal cooling operation. The second high-pressure pipe 39*b* has the same volume as the low-pressure pipe 40. The second high-pressure pipe 39*b* has the same thickness and the same length as the low-pressure pipe 40.

However, in one embodiment, the volume of the high pressure line 35 may be larger than the volume of the low pressure line 36 not only during cooldown operation but also during normal cooling operation. Instead of replacing the first high-pressure pipe 39*a* with the second high-pressure pipe 39*b*, the first high-pressure pipe 39*a* may be used during both of the cooldown operation and the normal cooling operation.

In a typical cryocooler, the volume of the high pressure line is not changed according to an operation state. The volume of the high pressure line is equal to the volume of the low pressure line. The high pressure side pipe and a low pressure side pipe, which connect the compressor and the cold head to each other, have the same dimensions (thickness and length).

In the specification, the volume of the high pressure line 35 can be defined as a pipe volume from the discharge port 18 to the high pressure port 37. The high pressure flow path 20 inside the compressor 12 and an internal flow path of the cold head 14 are not included in the high pressure line 35. Accordingly, the volume of the high pressure line 35 can substantially correspond to the volume of the high-pressure pipe 39 (that is, any one of the first high-pressure pipe 39*a* and the second high-pressure pipe 39*b*). Similarly, the volume of the low pressure line 36 can be defined as a pipe volume from the suction port 19 to the low pressure port 38. The low pressure flow path 21 inside the compressor 12 and the internal flow path of the cold head 14 are not included in the low pressure line 36. Accordingly, the volume of the low pressure line 36 can substantially correspond to the volume of the low-pressure pipe 40.

Figure 3:
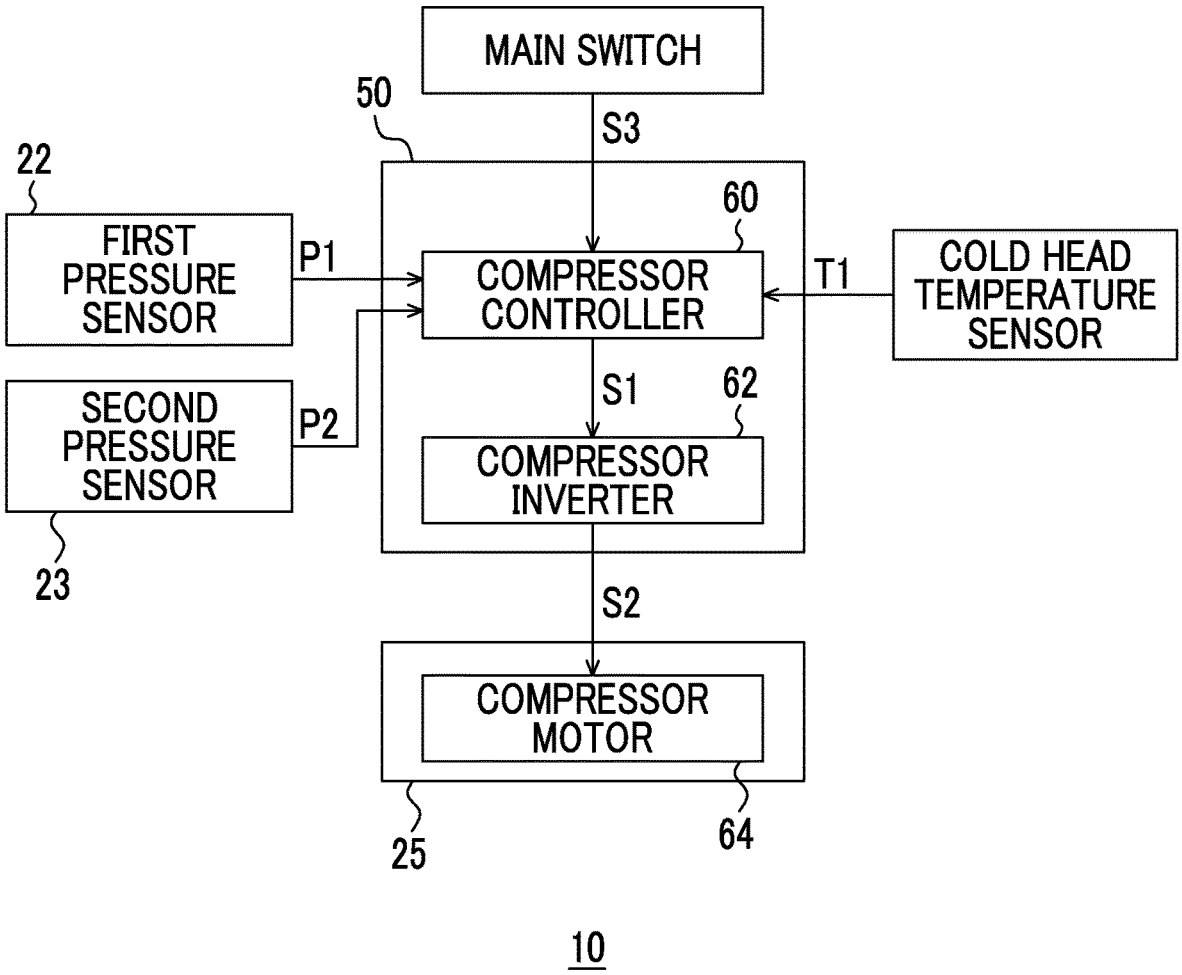
FIG. 3 is a block diagram related to the cryocooler.

FIG. 3 is a block diagram related to the cryocooler 10. The cryocooler 10 includes a control device 50 that controls the cryocooler 10. The control device 50 includes a compressor controller 60 and a compressor inverter 62. The control device 50 may be mounted on the compressor 12. The compressor main body 25 includes a compressor motor 64 that drives the compressor main body 25.

The first pressure sensor 22 and the second pressure sensor 23 are connected to the control device 50 so as to be able to communicate therewith, and output the first measured pressure signal P1 and the second measured pressure signal P2 to the control device 50, respectively. The cold head temperature sensor 30 is connected to the control device 50 so as to be able to communicate therewith, and outputs the measured temperature signal T1 to the control device 50.

The compressor controller 60 controls an operation frequency of the compressor 12 based on a pressure measured by the first pressure sensor 22 or based on a differential pressure measured by the first pressure sensor 22 and the second pressure sensor 23. Herein, for example, the operation frequency of the compressor 12 corresponds to a frequency of power supplied to the compressor motor 64, and refers to an operation frequency or a rotation speed of the compressor motor 64. The compressor controller 60 determines the operation frequency of the compressor 12, and generates an inverter control signal S1 according to the determined operation frequency of the compressor 12. In accordance with the inverter control signal S1, the compressor inverter 62 generates a motor drive signal S2 from power input from an external power source such as a commercial power source, and outputs the motor drive signal to the compressor motor 64. The compressor motor 64 is driven in response to the motor drive signal S2. In this manner, the compressor motor 64 is driven at the operation frequency determined by the compressor controller 60.

The main switch 28 is configured to output a starting command signal S3 to the control device 50 when operated. The compressor controller 60 receives the starting command signal S3, and begins the control of the compressor 12.

The control device 50 is realized by an element or a circuit including a CPU and a memory of a computer as a hardware configuration and is realized by a computer program as a software configuration, but is shown in FIG. 3 as a functional block realized in cooperation therewith. It is clear for those skilled in the art that the functional blocks can be realized in various manners in combination with hardware and software.

Figure 4:
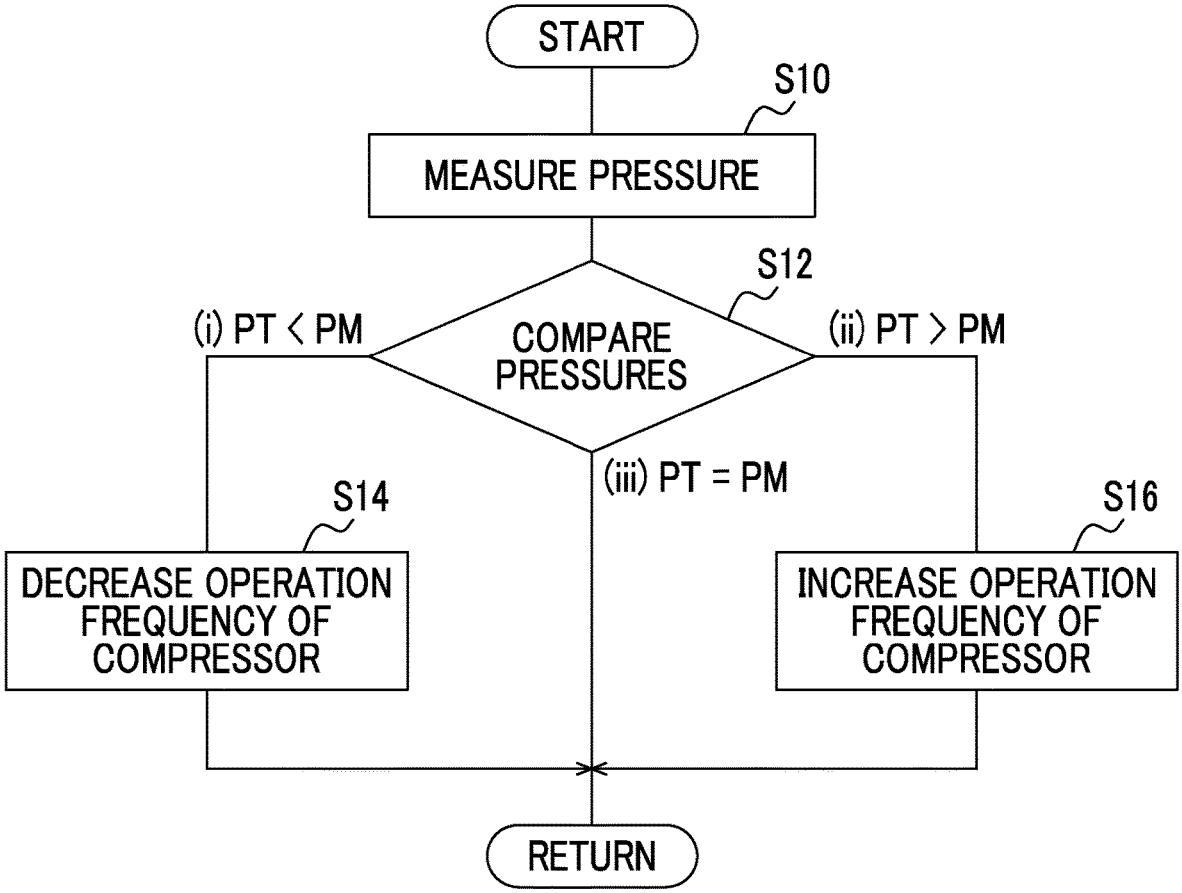
FIG. 4 is a flowchart showing a pressure control method for the cryocooler.

FIG. 4 is a flowchart showing a pressure control method for the cryocooler 10. The compressor controller 60 of the control device 50 is configured to execute pressure control processing of the pipe system 34 to be described below. The pressure control of the pipe system 34 is repeatedly executed at a predetermined cycle during the operation of the cryocooler 10.

The pressure of the pipe system 34 is measured (S10). The pressure of the pipe system 34 is measured using the pressure sensor. The compressor controller 60 acquires a measured pressure PM of the pipe system 34 from the first measured pressure signal P1 and/or the second measured pressure signal P2.

Next, the measured pressure PM of the pipe system 34 is compared to a target pressure PT (S12). The target pressure PT of the pipe system 34 is input to the control device 50 in advance by a user of the cryocooler 10, or is automatically set by the control device 50 and is stored in the control device 50. The compressor controller 60 compares the measured pressure PM to the target pressure PT and outputs a relationship as to which one of the measured pressure and the target pressure is larger or smaller as a comparison result. That is, the comparison result from the compressor controller 60 indicates any one of the following three states. (i) The measured pressure PM is larger than the target pressure PT. (ii) The measured pressure PM is smaller than the target pressure PT. (iii) The measured pressure PM is equal to the target pressure PT.

The compressor controller 60 determines the operation frequency of the compressor 12 based on the comparison result between the measured pressure PM and the target pressure PT. As described above, the compressor motor 64 is operated at the determined operation frequency. Accordingly, the measured pressure PM of the pipe system 34 is changed to become closer to the target pressure PT. In such a manner, the pressure control of the pipe system 34 is provided and thereby the measured pressure PM of the pipe system 34 can be made to follow the target pressure PT.

Specifically, (i) in a case where the measured pressure PM is larger than the target pressure PT, the compressor controller 60 decreases the operation frequency of the compressor 12 (S14). (ii) In a case where the measured pressure PM is smaller than the target pressure PT, the compressor controller 60 increases the operation frequency of the compressor 12 (S16). (iii) In a case where the measured pressure PM is equal to the target pressure PT, it is not necessary to increase or decrease the operation frequency, and thereby the operation frequency is maintained.

A changed amount (that is, an increased amount or a decreased amount) of the operation frequency of the compressor 12 may be determined based on a deviation between the measured pressure PM and the target pressure PT (for example, through PID control). Alternatively, the changed amount of the operation frequency of the compressor 12 may be an amount set in advance.

An example of the pressure control of the pipe system 34 is high pressure control for keeping the pressure of a working gas in the high pressure line 35 at a target value. In a case where the high pressure control is executed, a measured value from the first pressure sensor 22 is used as the measured pressure PM. In a case where the measured pressure PM is larger (smaller) than the target pressure PT, the measured pressure PM can be made smaller (larger) to become closer to the target pressure PT by decreasing (increasing) the operation frequency of the compressor 12.

The value of the target pressure PT used in the high pressure control may be a relatively large value within a pressure range that is allowable. Such an allowable pressure range is typically a pressure range where the compressor 12 is operable, and is determined in advance as a specification of the compressor 12. The value of the target pressure PT may be, for example, 80% or more or 90% or more of an upper limit value of the allowable pressure range, or may be equal to the upper limit value.

Another example of the pressure control of the pipe system 34 is differential pressure control for keeping a pressure difference between the high pressure line 35 and the low pressure line 36 at a target value. In a case where the differential pressure control is executed, a differential pressure measured value obtained by subtracting the measured value of the second pressure sensor 23 from the measured value of the first pressure sensor 22 is used as the measured pressure PM. In a case where the measured pressure PM is larger (smaller) than the target pressure PT, the measured pressure PM can be made smaller (larger) to become closer to the target pressure PT by decreasing (increasing) the operation frequency of the compressor 12.

Figure 5:
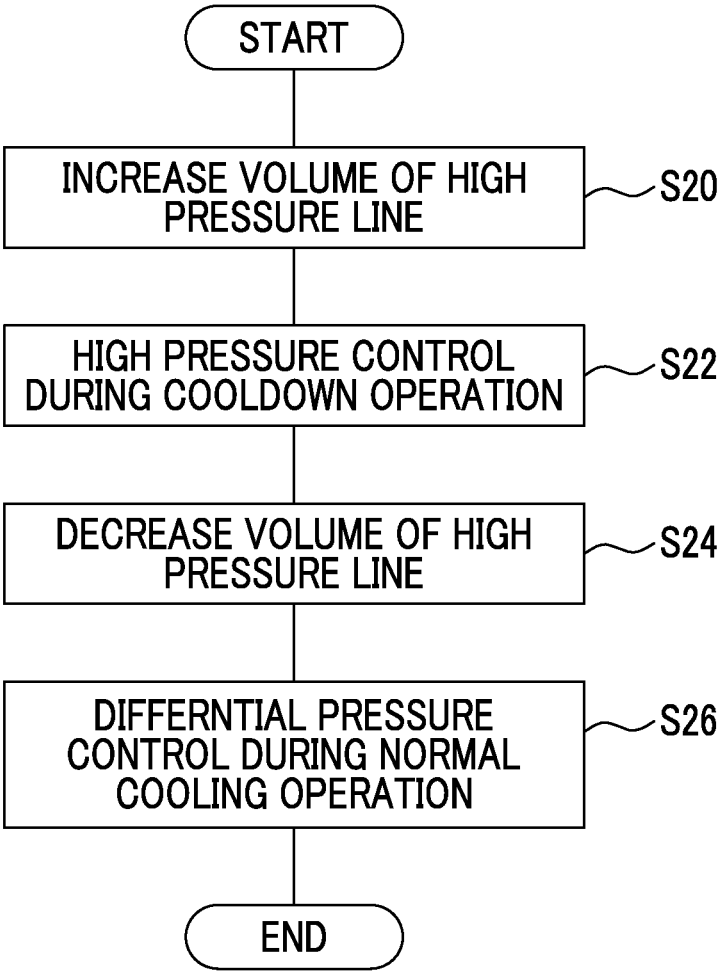
FIG. 5 is a flowchart showing a starting method for the cryocooler.

FIG. 5 is a flowchart showing a starting method for the cryocooler 10. This method is executed by, for example, the control device 50 when the main switch 28 is operated.

As shown in FIG. 5, the starting method includes increasing the volume of the high pressure line 35 (S20, hereinafter, also called a first step) when the cold head 14 is at the room temperature. The first step includes connecting the compressor 12 to the cold head 14 with the first high-pressure pipe 39*a*. As illustrated in FIG. 1, one end of the first high-pressure pipe 39*a* is connected to the discharge port 18, and the other end thereof is connected to the high pressure port 37. In this manner, the volume of the high pressure line 35 is increased. The low-pressure pipe 40 is already connected to the compressor 12 and the cold head 14.

The starting method includes, after the volume of the high pressure line 35 is increased, cooling the cold head 14 from the room temperature to the cryogenic temperature while controlling the operation frequency of the compressor 12 based on the pressure of the high pressure line 35 or a differential pressure between the high pressure line 35 and the low pressure line 36 (S22, hereinafter also called a second step). The second step includes cooling the cold head 14 from the room temperature to the cryogenic temperature and controlling the operation frequency of the compressor 12 such that the pressure of the high pressure line 35 follows a pressure target value.

The starting method includes, after the cold head 14 is cooled to the cryogenic temperature, decreasing the volume of the high pressure line 35 (S24, hereinafter, also called a third step). The third step includes connecting the compressor 12 to the cold head 14 with the second high-pressure pipe 39*b*. The first high-pressure pipe 39*a* is removed, and the second high-pressure pipe 39*b* is connected to the discharge port 18 and the high pressure port 37 instead. Since the volume of the first high-pressure pipe 39*a* is larger than the volume of the second high-pressure pipe 39*b* as described above, the volume of the high pressure line 35 is decreased.

The starting method includes, after the volume of the high pressure line 35 is decreased, maintaining the cold head 14 at the cryogenic temperature (S26, hereinafter, also called a fourth step). The fourth step includes controlling the operation frequency of the compressor 12 such that a differential pressure between the high pressure line 35 and the low pressure line 36 follows a differential pressure target value. After the fourth step, the normal cooling operation of the cryocooler 10 is performed.

In the second step, it is also possible to automatically transition from cooldown operation to normal cooling operation based on the measured temperature of the low-temperature section 14*b* of the cold head 14. Such an example will be described.

Figure 6:
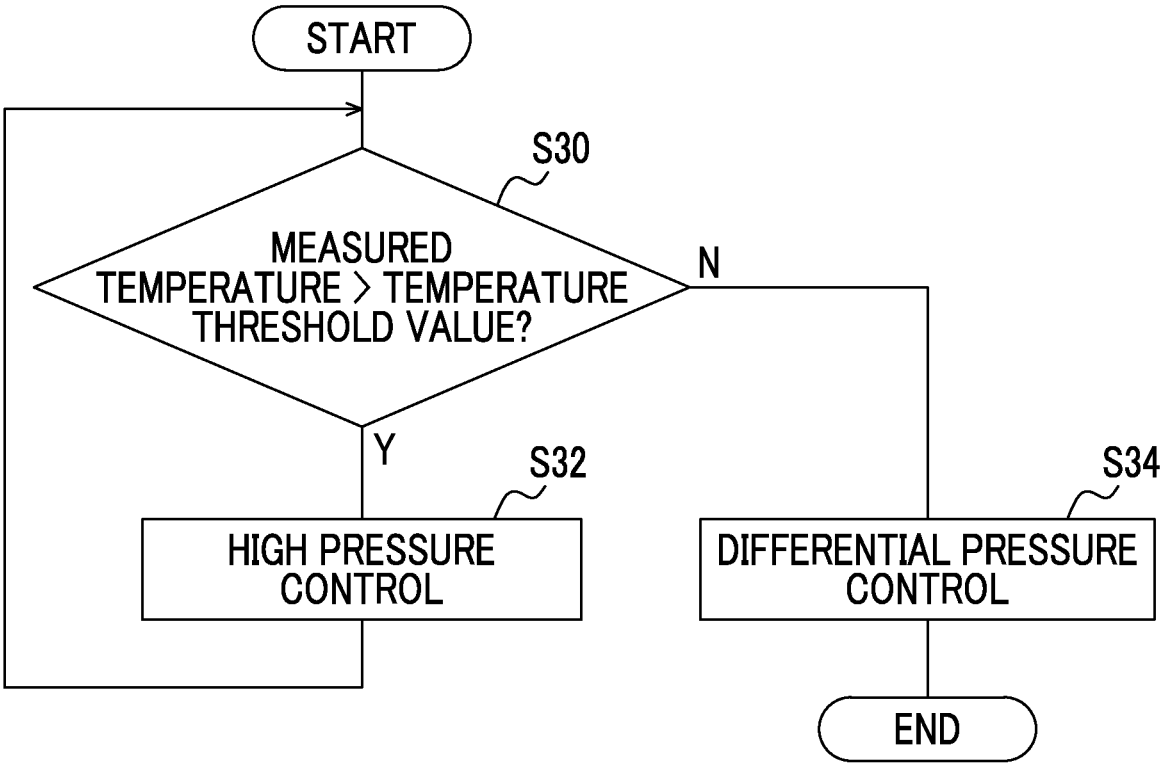
FIG. 6 is a flowchart showing an example of a second step of the starting method.

FIG. 6 is a flowchart showing an example of the second step of the starting method. As shown, the compressor controller 60 compares the measured temperature of the low-temperature section 14*b* to a temperature threshold value based on the measured temperature signal T1 from the cold head temperature sensor 30 (S30). The temperature threshold value is, for example, the target cooling temperature (for example, approximately 4 K to approximately 50 K) of the cold head 14.

In a case where the measured temperature exceeds the temperature threshold value (Y of S30), high pressure control is executed (S32). When the cold head 14 is cooled from the room temperature to the cryogenic temperature, the compressor controller 60 controls the operation frequency of the compressor 12 such that the pressure of the high pressure line 35 measured by the pressure sensor follows the pressure target value, based on the temperature measured by the cold head temperature sensor 30.

In a case where the measured temperature is equal to or lower than the temperature threshold value (N of S30), differential pressure control is executed (S34). When the cold head 14 is maintained at the cryogenic temperature, the compressor controller 60 controls the operation frequency of the compressor 12 such that a differential pressure between the high pressure line 35 and the low pressure line 36, which is measured by the pressure sensor, follows the differential pressure target value, based on the temperature measured by the cold head temperature sensor 30.

In this manner, high pressure control is executed during cooldown operation, and differential pressure control is executed during normal cooling operation. After transition to the normal cooling operation, the third step can be performed. Alternatively, after transition to the normal cooling operation, it is possible not to perform the third step.

The configuration of the cryocooler 10 according to the embodiment has been described hereinbefore. Next, the operation thereof will be described. When the main switch 28 is operated, the cryocooler 10 begins cooldown operation. In this case, high pressure control is performed in the compressor 12. Since the pressure target value of the high pressure control is set to a relatively large value, the pressure of the high pressure line 35 does not satisfy the target value in general. Accordingly, the operation frequency of the compressor 12 is increased and the rotation speed of the compressor motor 64 is increased such that the pressure of the high pressure line 35 is increased to become the target value. In addition, since the volume of the high pressure line 35 is increased, the high pressure line 35 is unlikely to be pressurized. This also works to increase the operation frequency of the compressor 12.

Then, the flow rate of a working gas supplied from the compressor 12 to the cold head 14 through the high pressure line 35 increases, and also the flow rate of the working gas collected from the cold head 14 to the compressor 12 through the low pressure line 36 increases. For this reason, a differential pressure between the high pressure line 35 and the low pressure line 36 becomes large. In theory, the cooling capacity of the cryocooler 10 is proportional to the differential pressure. Accordingly, when the differential pressure increases, the cooling capacity of the cryocooler 10 improves. The cooling speed of the cold head 14 is increased.

Therefore, with the cryocooler 10 according to the embodiment, cooldown time can be shortened.

In cooling an object to be cooled, such as a superconducting device, with the cryocooler 10, there are two methods in general. That is, there are a so-called conduction cooling method of cooling the object to be cooled by bringing the object to be cooled into contact with the low-temperature section 14*b* of the cold head 14 and a method of cooling a refrigerant such as liquid helium with the low-temperature section 14*b* and cooling the object to be cooled with the use of the refrigerant. In the refrigerant method, when the refrigerant is stored, the object to be cooled can be cooled even during non-operation (for example, maintenance) or cooldown of the cryocooler 10. However, in the conduction cooling method, the object to be cooled cannot be cooled during the non-operation or cooldown of the cryocooler 10 or cooling is insufficient. Therefore, the cryocooler 10 according to the embodiment is particularly suitable for a cryogenic system under the conduction cooling method in that cooldown time can be shortened.

With the cryocooler 10 according to the embodiment, high pressure control can be combined with cooldown operation. In the high pressure control, by setting the pressure target value of the high pressure line 35 to the upper limit value of the allowable pressure range or a value close thereto, the pressure of the high pressure line 35 can be controlled such that the pressure becomes such a relatively large value, and the cooling capacity of the cryocooler 10 during the cooldown operation can be easily maintained at a high level.

On the other hand, in a case of combining cooldown operation with differential pressure control, the differential pressure target value can be increased in order to improve the cooling capacity of the cryocooler 10. In this case, it is not clear if the pressure of the high pressure line 35 obtained as a result thereof is maintained within the allowable pressure range. The same applies to the pressure of the low pressure line 36. When the pressure of any one of the high pressure line 35 and the low pressure line 36 deviates from the allowable pressure range, the compressor 12 can output a warning or automatically stop the operation. It may be necessary to restart the compressor 12. It is not preferable when time taken for the cooldown operation is extended.

In addition, with the cryocooler 10 according to the embodiment, normal cooling operation is combined with differential pressure control. Since the operation frequency of the compressor 12 can be appropriately adjusted according to the load of the cold head 14, the differential pressure control is useful in reducing power consumption of the cryocooler 10.

Figure 7:
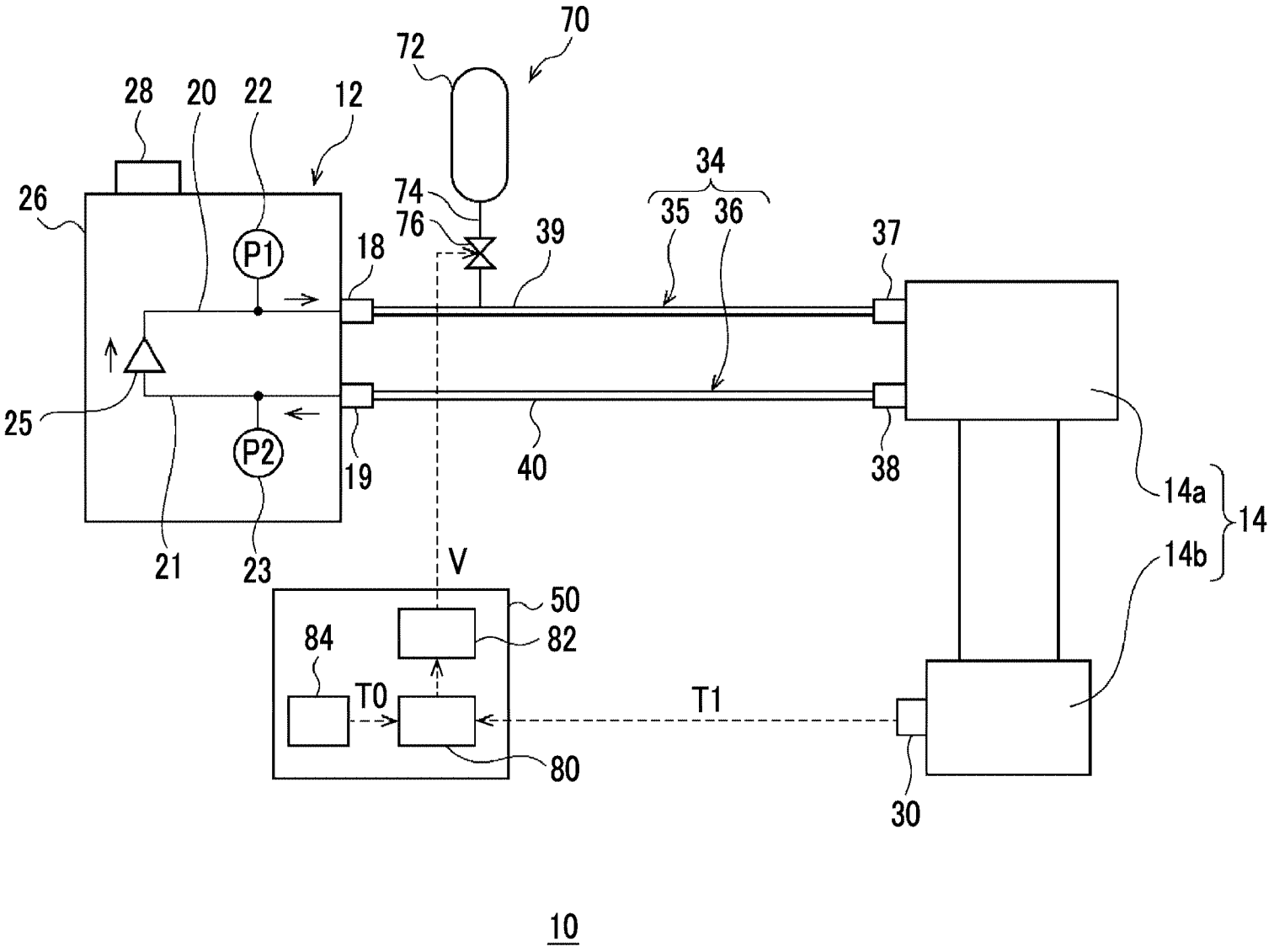
FIG. 7 is a view schematically illustrating a cryocooler according to another embodiment.

FIG. 7 is a view schematically illustrating the cryocooler 10 according to another embodiment. The cryocooler 10 according to another embodiment is different from the cryocooler 10 according to the one embodiment in terms of a configuration where it is possible to change the volume of the high pressure line 35, but the rest is mostly the same. Hereinafter, different configurations will be mainly described, and common configurations will be briefly described or description thereof will be omitted.

The pipe system 34 includes a buffer volume 70 configured to be connected to the high pressure line 35 when the cold head 14 is cooled from the room temperature to the cryogenic temperature and to be disconnected from the high pressure line 35 when the cold head 14 is maintained at the cryogenic temperature. The first step shown in FIG. 5 includes connecting the buffer volume 70 to the high pressure line 35. The third step includes disconnecting the buffer volume 70 from the high pressure line 35.

The buffer volume 70 includes a buffer tank 72, a connecting pipe 74 that connects the buffer tank 72 to the high pressure line 35, and a valve 76 that is provided on the connecting pipe 74. The connecting pipe 74 branches from the high-pressure pipe 39.

The valve 76 is configured to control the flow of a working gas in the connecting pipe 74. The valve 76 is controlled in accordance with a valve control signal V input from the control device 50. That is, the valve 76 is opened and closed or an opening degree thereof is adjusted in accordance with the valve control signal V. The valve 76 is connected to the control device 50 so as to be able to communicate therewith such that the valve receives the valve control signal V.

When the valve 76 is opened, the buffer tank 72 communicates with the high pressure line 35 through the connecting pipe 74, allowing the flow of a working gas between the buffer tank 72 and the high pressure line 35. In this manner, the volume of the high pressure line 35 is increased. When the valve 76 is closed, the buffer tank 72 is disconnected from the high pressure line 35, blocking the flow of the working gas between the buffer tank 72 and the high pressure line 35. In this manner, the volume of the high pressure line 35 is decreased.

The control device 50 controls the valve 76 based on a temperature measured by the cold head temperature sensor 30, and accordingly changes the volume of the high pressure line 35.

The control device 50 includes a temperature comparison unit 80 and a valve control unit 82. The temperature comparison unit 80 is configured to compare the measured temperature of the low-temperature section 14*b* to a temperature threshold value T0 based on the measured temperature signal T1. The temperature comparison unit 80 is configured to output the result of temperature comparison to the valve control unit 82. The valve control unit 82 is configured to generate the valve control signal V in accordance with the input from the temperature comparison unit 80. The valve control unit 82 opens the valve 76 when the measured temperature is higher than the temperature threshold value T0, and closes the valve 76 when the measured temperature is equal to or lower than the temperature threshold value T0. The temperature threshold value T0 may be, for example, the target cooling temperature of the cold head 14, or may be determined in advance from, for example, a temperature range of approximately 4 K to approximately 50 K. The control device 50 may include a storage unit 84 that stores the temperature threshold value T0.

Accordingly, the valve 76 is opened during cooldown operation, and the valve 76 is closed during normal cooling operation.

As in the one embodiment, the control device 50 may include the compressor controller 60, and execute control processing shown in FIG. 6. Accordingly, when the measured temperature is higher than the temperature threshold value T0, the valve 76 is opened to increase the volume of the high pressure line 35, and high pressure control is executed. When the measured temperature is equal to or lower than the temperature threshold value T0, the valve 76 is closed to decrease the volume of the high pressure line 35, and differential pressure control is executed.

Therefore, with the cryocooler 10 according to another embodiment, cooldown time can be shortened as in the one embodiment.

Figure 8A:
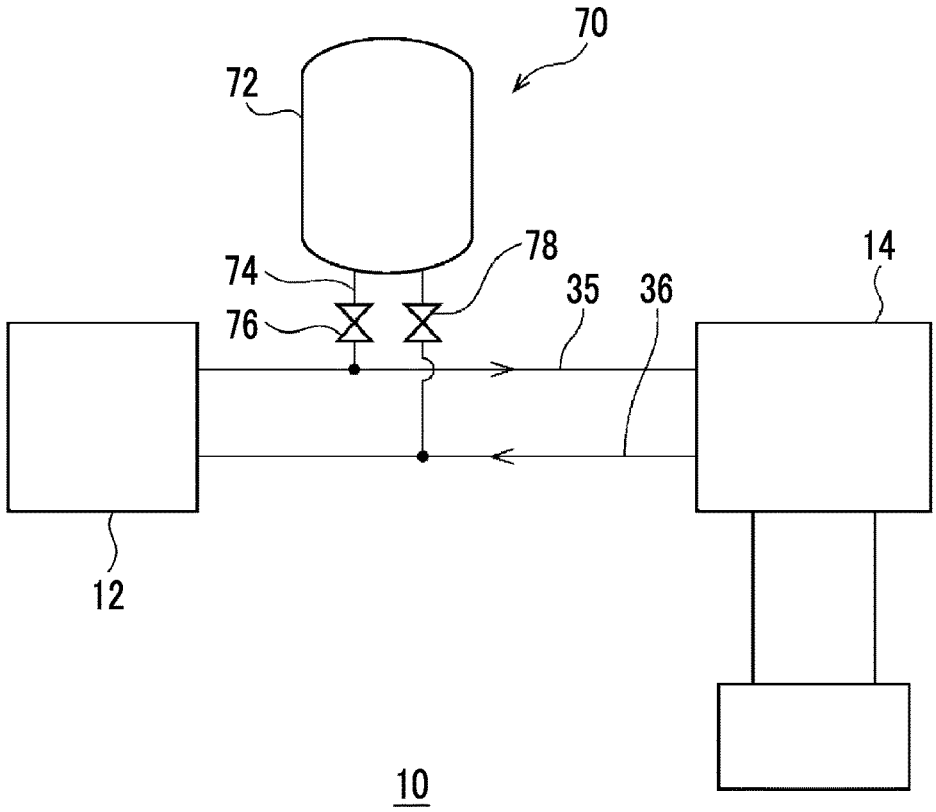
FIGS. 8A and 8B illustrate other examples of a buffer volume.
Figure 8B:
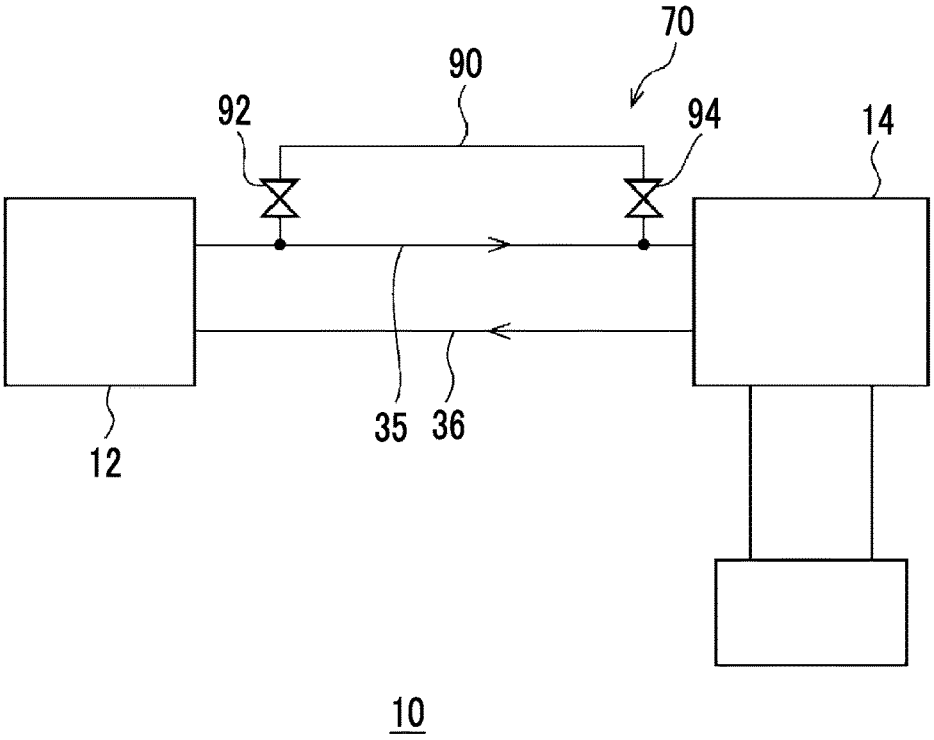

FIGS. 8A and 8B illustrate other examples of the buffer volume 70. As illustrated in FIG. 8A, the buffer tank 72 may be connected not only to the high pressure line 35 but also to the low pressure line 36. The valve 76 is provided on the connecting pipe 74 on the high pressure side, which connects the buffer tank 72 to the high pressure line 35. Another valve 78 is provided on a connecting pipe on the low pressure side, which connects the buffer tank 72 to the low pressure line 36. For example, by opening the valve 78 in a timely manner during normal cooling operation, the pressure of the buffer tank 72 can return to an initial pressure, which is convenient.

It is not essential for the buffer volume 70 to take the form of a tank. As illustrated in FIG. 8B, the buffer volume 70 may include a buffer pipe 90 that is connected in parallel to the high pressure line 35 and valves 92 and 94 that are provided at an inlet and an outlet of the buffer pipe 90. The buffer pipe 90 is connected to the high pressure line 35 by the valves 92 and 94. The volume of the high pressure line 35 is increased by opening the valves 92 and 94, and the volume of the high pressure line 35 is decreased by closing the valves 92 and 94.

The present invention has been described hereinbefore based on the examples. It is clear for those skilled in the art that the present invention is not limited to the embodiments, various design changes are possible, various modification examples are possible, and such modification examples are also within the scope of the present invention. Various characteristics described in relation to one embodiment are also applicable to other embodiments. A new embodiment generated through combination also has the effects of each of the combined embodiments.

Although cooldown operation is combined with high pressure control in the embodiment described above, if circumstances permit, the cooldown operation may be combined with differential pressure control in the cryocooler 10 according to the embodiment.

Although the present invention has been described using specific phrases based on the embodiments, the embodiments merely show one aspect of the principles and applications of the present invention, and many modification examples and changes in disposition are allowed without departing from the gist of the present invention defined in the claims.

It is possible to use the present invention in the fields of a starting method for a cryocooler and a cryocooler.

It should be understood that the invention is not limited to the above-described embodiment, but may be modified into various forms on the basis of the spirit of the invention. Additionally, the modifications are included in the scope of the invention.

What is claimed is:

1. A starting method for a cryocooler, the cryocooler including a compressor, a cold head, a high pressure line through which a refrigerant gas is supplied from the compressor to the cold head, and a low pressure line through which the refrigerant gas is collected from the cold head to the compressor, the method comprising:

increasing a volume of the high pressure line when the cold head is at a room temperature;

cooling the cold head from the room temperature to a cryogenic temperature while controlling an operation frequency of the compressor based on a pressure of the high pressure line or a differential pressure between the high pressure line and the low pressure line, after the volume of the high pressure line has been increased;

decreasing the volume of the high pressure line after the cold head has been cooled to the cryogenic temperature; and maintaining the cold head at the cryogenic temperature after the volume of the high pressure line has been decreased.

2. The method according to claim 1, wherein the cooling of the cold head from the room temperature to the cryogenic temperature includes controlling the operation frequency of the compressor such that the pressure of the high pressure line follows a pressure target value.

3. The method according to claim 1, wherein the maintaining of the cold head at the cryogenic temperature includes controlling the operation frequency of the compressor such that the differential pressure between the high pressure line and the low pressure line follows a differential pressure target value.

4. The method according to claim 1, wherein the increasing of the volume of the high pressure line includes connecting the compressor to the cold head with a first high-pressure pipe, the decreasing of the volume of the high pressure line includes connecting the compressor to the cold head with a second high-pressure pipe, and a volume of the first high-pressure pipe is larger than a volume of the second high-pressure pipe.

5. The method according to claim 1, wherein the increasing of the volume of the high pressure line includes connecting a buffer volume to the high pressure line, and the decreasing of the volume of the high pressure line includes disconnecting the buffer volume from the high pressure line.

6. A cryocooler comprising:

a compressor;

a cold head;

a high pressure line through which a refrigerant gas is supplied from the compressor to the cold head;

a low pressure line through which the refrigerant gas is collected from the cold head to the compressor;

a pressure sensor that measures a pressure of the high pressure line or a differential pressure between the high pressure line and the low pressure line;

a compressor controller that controls an operation frequency of the compressor based on the pressure measured by the pressure sensor; and a buffer volume configured to be connected to the high pressure line when the cold head is cooled from a room temperature to a cryogenic temperature, and the buffer volume is configured to be disconnected from the high pressure line when the cold head is maintained at the cryogenic temperature.

7. A cryocooler comprising:

a compressor;

a cold head;

a high pressure line through which a refrigerant gas is supplied from the compressor to the cold head;

a low pressure line through which the refrigerant gas is collected from the cold head to the compressor;

a pressure sensor that measures a pressure of the high pressure line or a differential pressure between the high pressure line and the low pressure line; and a compressor controller that controls an operation frequency of the compressor based on the pressure measured by the pressure sensor, wherein a volume of the high pressure line is larger than a volume of the low pressure line.

8. The cryocooler according to claim 6, wherein the compressor controller controls the operation frequency of the compressor such that the pressure of the high pressure line, measured by the pressure sensor, follows a pressure target value, when the cold head is cooled from the room temperature to the cryogenic temperature.

9. The cryocooler according to claim 8, wherein the compressor controller controls the operation frequency of the compressor such that the differential pressure between the high pressure line and the low pressure line, measured by the pressure sensor, follows a differential pressure target value, when the cold head is maintained at the cryogenic temperature.

10. The method according to claim 1, wherein the cooling of the cold head from the room temperature to the cryogenic temperature comprises:

measuring a temperature of the cold head, comparing the measured temperature of the cold head to a temperature threshold value, and when the measured temperature of the cold head exceeds the temperature threshold value, controlling the operation frequency of the compressor such that the pressure of the high pressure line follows a pressure target value.

11. The method according to claim 10, wherein the cooling of the cold head from the room temperature to the cryogenic temperature comprises:

when the measured temperature of the cold head is below the temperature threshold value, controlling the operation frequency of the compressor such that the differential pressure between the high pressure line and the low pressure line follows a differential pressure target value.

12. A starting method for a cryocooler, the cryocooler including a compressor, a cold head, a high pressure line through which a refrigerant gas is supplied from the compressor to the cold head, and a low pressure line through which the refrigerant gas is collected from the cold head to the compressor, the method comprising:

increasing a volume of the high pressure line when the cold head is at a room temperature; and cooling the cold head from the room temperature to a cryogenic temperature after the volume of the high pressure line has been increased, wherein the cooling of the cold head from the room temperature to the cryogenic temperature comprises:

measuring a temperature of the cold head, comparing the measured temperature of the cold head to a temperature threshold value, and when the measured temperature of the cold head exceeds the temperature threshold value, controlling the operation frequency of the compressor such that the pressure of the high pressure line follows a pressure target value.

* * * * *